US009511827B2

(12) United States Patent
Lowell

(10) Patent No.: US 9,511,827 B2
(45) Date of Patent: Dec. 6, 2016

(54) LEASH RETAINING FIN

(71) Applicant: John Lowell, Los Angeles, CA (US)

(72) Inventor: John Lowell, Los Angeles, CA (US)

( * ) Notice: Subject to any disclaimer, the term of this patent is extended or adjusted under 35 U.S.C. 154(b) by 80 days.

(21) Appl. No.: 14/255,723

(22) Filed: Apr. 17, 2014

(65) Prior Publication Data

US 2015/0298776 A1 Oct. 22, 2015

(51) Int. Cl.
*B63B 35/79* (2006.01)

(52) U.S. Cl.
CPC ..... *B63B 35/7926* (2013.01); *B63B 2035/794* (2013.01)

(58) Field of Classification Search
CPC ... E05B 73/007; B63B 35/793; B63B 35/7926
USPC ..... 441/75; D21/778; 440/75
See application file for complete search history.

(56) References Cited

U.S. PATENT DOCUMENTS

| | | | | |
|---|---|---|---|---|
| 5,362,270 | A * | 11/1994 | Hanson | B63B 35/7946 114/39.19 |
| D437,907 | S * | 2/2001 | Stuart | D12/317 |
| 6,942,532 | B2 | 9/2005 | Snyder | |
| 7,204,734 | B2 * | 4/2007 | Kawasaki | B63B 35/7933 441/75 |
| D568,429 | S * | 5/2008 | Takayama | D21/778 |
| D680,606 | S * | 4/2013 | McKee | D21/778 |
| 2005/0064775 | A1 * | 3/2005 | White | B63B 35/793 441/79 |
| 2012/0305725 | A1 * | 12/2012 | Dackow | F16G 11/00 248/231.81 |

* cited by examiner

*Primary Examiner* — Andrew Polay
(74) *Attorney, Agent, or Firm* — Baker and Rannells, PA

(57) ABSTRACT

A fin shaped and sized to connect to a leash so that the leash is securely stored during transport or storage. In an embodiment, a leash may be wrapped about a board and a portion thereof connected to connecting means formed about a fin, not limited to a notch, a hole, or combinations thereof.

2 Claims, 2 Drawing Sheets

LEASH RETAINING FIN

FIELD OF THE INVENTION

The present invention is in the field of water type vessels. In particular, the invention may pertain to recreation vessels that include leveling means, such as a fin, and use a tether.

BACKGROUND OF THE INVENTION

Surfing and body boarding are well-known water sports that consist essentially of a vessel (i.e., board) that has an upper surface that may support things not limited to a rider; and a lower surface that comprises a leveling and or steering device such as a fin used to provide balance and steering when propelled for example, by a motor, current, swell, wave, etc.

In some instances, a tether (leash) may be used to connect things to a board so that should the two separate, neither could exceed a distance greater than the length of the leash for example. Therefore, the use of a leash has become a popular addition to many boards (including but not limited to any vessel including a surfboard, body board, boogie board, wind surfing board, boat, or other similar applications that comprise a leveling device and incidence of separation that may include retrieval).

The length of a tether may vary depending on the vessel being used. When regarding surfboards, it may be typical for the length of a leash to be approximately the length of the board to which it applies. Generally, the leash has a first end that originates at an area on or above an upper surface of a board and a second end that comprises means to connect to a rider, either directly or indirectly.

When a vessel is not in use, being transported, stored, or otherwise not requiring a leash, the leash may be stored about the vessel. For example, a leash may be looped and or winded about a board with a second end anchored to a portion of the leash or looped around a fin. Loops currently available are not designed to properly secure to its leash or fin. As a result, it is not uncommon for a stored leash to become undone.

The following are some examples that provide attempts to secure a leash, and include, Publication No. US 20120305725 (Dacow) is for a Leash Anchor and Board Incorporating Same. In FIGS. 25A-25F Dacow discloses how a slit may be formed in the actual body of the board that is designed to particularly capture a support strap 200 within notch 710. Dacow at paragraph [0038].

U.S. Pat. No. 6,942,532 (Snyder) is for a Clip for Surfboard Leash. As shown in FIGS. 4A and 4B, a clip is attached to a portion of a leash with a notch formed thereon, which is capable of connecting to a portion of the leash when wrapped around a board. The clip is removeable (Snyder at col. 3, lines 3-7).

U.S. Pat. No. 5,362,270 (Hanson et al.) is for a Surfboard Leash Retainer. As shown in FIG. 1, the invention is for a clip retainer that is attached to the forward end of a surfboard and retains the second end (i.e., "distal or surfer ankle attachment) when being transported (Hanson et al. at col. 1, lines 35-40).

Because the references require altering the appearance of the board (Dacow) or addition of retaining pieces (Snyder and Hanson et al.) there is a need in the art for improved means to secure a leash to a board that overcomes the current obstacles.

BRIEF SUMMARY OF THE INVENTION

It is an object of the invention to provide means to connect a tether to a vessel when a tether is not in use.

An embodiment of the invention includes a vessel having at least one leveling and or steering device shaped and sized to connect to a portion of a tether.

In an embodiment where the vessel may include a board, such as a surfboard or body board, or the like, wherein a vessel has at least one fin disposed about an underside, said fin may be shaped and sized so it can releaseably connect to a tether (i.e., leash).

BRIEF DESCRIPTION OF THE DRAWINGS

The invention is explained in the following description in view of the drawings that show.

DETAILED DESCRIPTION OF THE INVENTION

The invention includes an embodiment comprising a vessel 20 having at least one fin 30 that is shaped and sized to releaseably connect to a tether 10.

Figure 1:
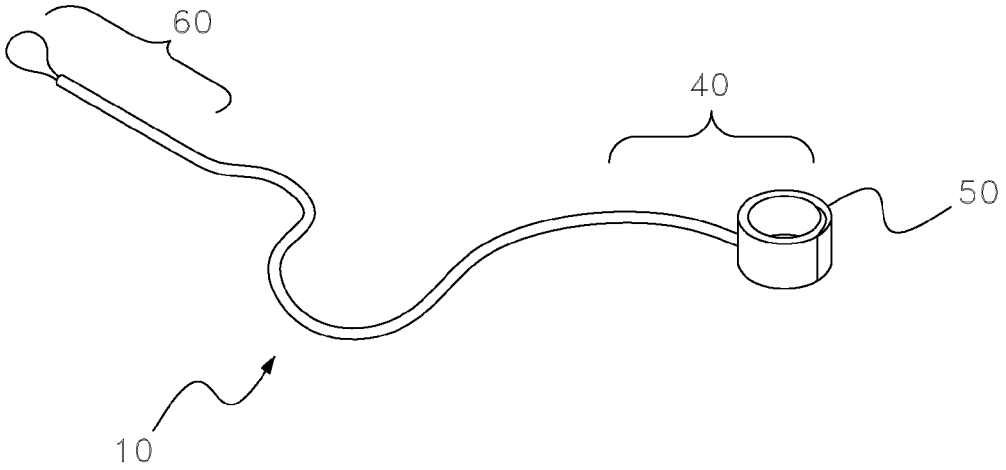
FIG. 1 is a perspective view of an embodiment of a tether.

As shown in FIG. 1, a tether 10 may essentially comprise of cord or other similar type of connection means, not limited to a chain, rope, string, cable, wire or other known means in the art that may consist of material that allows said cord to embody resiliency or rigidness, depending on vessel type, use, or need of a user. In an embodiment shown in FIG. 1, tether 10 has a first portion 60 that comprises means to couple and or connects to a vessel 20 (such as a ship, a boat, a board, a surfboard, a kite board, a body board, a boogie board, a wind surf board, a paddle board or other type of devices that may incorporate use of a tether 10) and a second portion 40 which comprises means, for example a strap 50, that is capable of securing to objects and or things such as a component of a boat (like a sail), a person, game, and or bait, for example.

Figure 2:
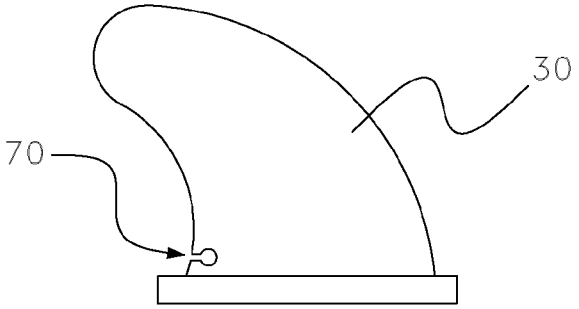
FIG. 2 is a side view of a fin according to an embodiment of the instant invention.

FIG. 2 provides an embodiment of a leveling and or steering device 30 that comprises means 70 capable of retaining a tether 10 for a period of time. In an embodiment, the leveling and or steering device may consist essentially of a fin as shown. The particular shape and size of fins are generally well-known in the art, and may be shaped and sized to conform to specific requirements or needs of a rider or operator which may also depend on the type of vessel used. As shown, fin 30 may be selectively removable, mendable or permanent and may include any protrusion disposed about an underside of a vessel 20.

As shown in FIG. 2, means 70 may be disposed about the base of fin 30 along a posterior edge and is shaped and sized to restrain, secure, or connect to a tether 10. Means 70 may include a notch, slit or other known frictional means and may be selectively disposed at a location anywhere about fin 30, not limited to an edge. Furthermore, a leveling and or steering device 30 may comprise more than one means 70 disposed thereto. For example, in an embodiment when the vessel 20 is a board, and leash 10 may be wrapped about a rear edge of said board 20, depending on where the second portion 40 of said leash 10 is located based on the wrap—or if a leash is replaced and the size or resiliency is different—it may be desirable to connect the leash to an anterior edge in one instance or the posterior edge in another.

In an embodiment, a hole (not shown) is formed through fin 30, wherein said tether 10 is threaded there through and retained by frictional means disposed about an edge of said hole, not limited to a notch or slit. Additionally, it is an embodiment of the invention that when said fin 30 comprises a hole (not shown) as means 70, said tether 10 may comprise complimentary means disposed about the second portion 40 for example, such that it may connect to said hole formed within said fin 30 in a method or fashion commonly known as a toggle and or hook-and-eye connection (see for example, FIGS. 1 and 2 of U.S. Pat. No. 8,205,471 incorporated herein).

Figure 3:
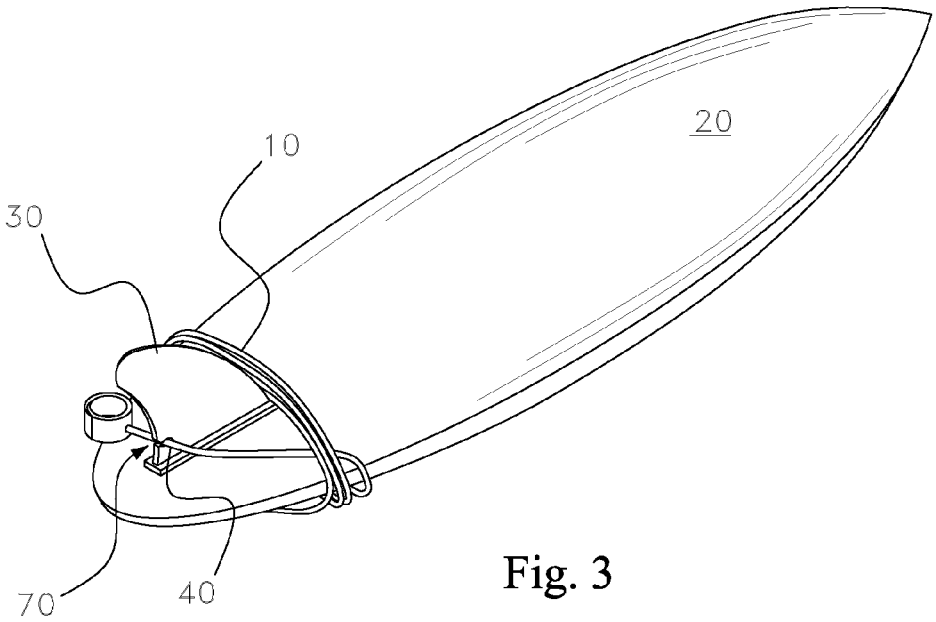
FIG. 3 is a right side, perspective view of an embodiment of the instant invention showing the lower surface (i.e., underside) of a board having a leash wrapped thereto, with said leash connected to a posterior edge of a fin.

FIG. 3 shows an embodiment of the invention when vessel 20 is a surfboard that is not in use, being transported, stored, or otherwise not requiring a leash, whereby the leash may be stored about the board. As shown, vessel 20 has one fin 30 however is an embodiment of the invention that a vessel 20 may comprise more than one fin 30 and or more than one fin 30 that may connect to a tether 10. As shown, tether (leash) 10 is wrapped about the rear of surfboard 20 and the second portion 40 of the leash 10 connects to fin 30. As shown, means 50 is connected to said tether 10 and may include an adjustable band, for example, used to connect the vessel 20 to something.

Figure 4:
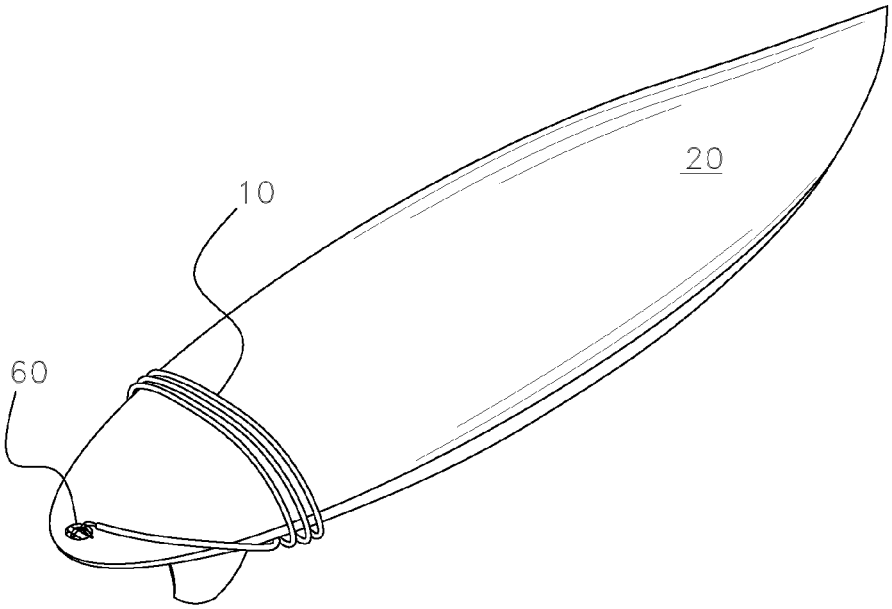
FIG. 4 is a top perspective view of the embodiment in FIG. 3 showing an upper surface of a board.

FIG. 5 is a top perspective view of the embodiment in FIGS. 3 and 4, showing first portion 60 of leash 10 connected to the upper surface of board 20, about the rear of said board. As shown, leash 10 is wrapped about board 20 in a stored manner. The location of first portion 60 is not limited to an upper surface of a board, as it is understood that a tether 10 may originate and or secure to a board, ship or other type of vessel or device at other areas depending on design, use, etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A fin for a sports board capable of connecting to a tether, wherein the fin comprises:

a forward edge;

a rear edge;

two sides and a retainer, wherein the retainer is shaped and sized to secure a portion of a tether and comprises: a slot that has a height parallel to the edge, that extends through one edge and two sides;

and, a hole that has a diameter greater than about the height of the slot, so that the tether can enter the slot and be retained by the hole.

2. The fin for a sports board as recited in claim 1 whereby the sports board is a vessel selected from the group consisting of, a board, a surfboard, a kite board, a body board, a wind surf board, and a paddle board.

* * * * *